US006534912B1

(12) United States Patent
Takano et al.

(10) Patent No.: US 6,534,912 B1
(45) Date of Patent: Mar. 18, 2003

(54) ACTIVE MATRIX DRIVE FLUORESCENT DISPLAY DEVICE AND METHOD FOR MANUFACTURING SAME

(75) Inventors: Sadao Takano, Mobara (JP); Akihiro Mihira, Mobara (JP); Akihiro Azeta, Mobara (JP); Toshihide Hirayama, Mobara (JP); Kenichi Honda, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/311,069

(22) Filed: May 13, 1999

(30) Foreign Application Priority Data

May 20, 1998 (JP) ..... 10-138680

(51) Int. Cl.[7] ..... H01J 21/00; H01J 19/78; H01J 63/02

(52) U.S. Cl. ..... 313/497; 313/518; 445/58

(58) Field of Search ..... 313/422, 495, 313/497, 444, 359.1, 360.1, 496, 493, 514, 518, 519, 522; 445/24, 58; 257/59, 72, 342; 156/60, 89, 284, 285; 228/123.1

(56) References Cited

U.S. PATENT DOCUMENTS 4,041,348 A * 8/1977 Eto et al. ..... 313/497
4,100,456 A * 7/1978 Kobayakawa et al. ..... 313/497
4,190,855 A * 2/1980 Inoue ..... 257/668
4,970,575 A * 11/1990 Soga et al. ..... 257/688
5,001,542 A * 3/1991 Tsukagoshi et al. ..... 357/68
5,347,292 A * 9/1994 Ge et al. ..... 345/74
5,424,605 A * 6/1995 Lovoi ..... 313/422
5,469,333 A * 11/1995 Ellerson et al. ..... 257/790
5,903,097 A * 5/1999 Lee ..... 313/493
6,063,876 A * 5/2000 Hayakawa et al. ..... 523/427
6,078,137 A * 6/2000 Tojo et al. ..... 313/495
6,129,603 A * 10/2000 Sun et al. ..... 445/25

* cited by examiner

*Primary Examiner*—Michael H. Day
*Assistant Examiner*—Mariceli Santiago
(74) *Attorney, Agent, or Firm*—Oblon, Spivak, McClelland, Maier & Neustadt, P.C.

(57) ABSTRACT

An active matrix drive fluorescent display device capable of preventing misluminescence of phosphor layers. A semiconductor chip which includes a plurality of luminous dots arranged in a matrix-like manner and is arranged in an envelope is covered on a cut surface thereof rendered electrically GND with an insulating cover layer. Such construction eliminates a failure in insulation between electrodes arranged on the semiconductor chip, to thereby prevent misluminescence of the luminous dots, leading to an increase in display quality.

3 Claims, 3 Drawing Sheets

ACTIVE MATRIX DRIVE FLUORESCENT DISPLAY DEVICE AND METHOD FOR MANUFACTURING SAME

BACKGROUND OF THE INVENTION

This invention relates to an active matrix drive fluorescent display device and a method for manufacturing the same, and more particularly, to an active matrix drive type fluorescent display device in which a semiconductor chip having a plurality of anodes individually driven and arranged in a matrix-like manner thereon is fixed on an inner surface of a substrate of an envelope and which is constructed so as to prevent misluminescence of the anodes due to a failure in insulation between, electrodes.

A conventional active matrix drive fluorescent display device typically includes an envelope constructed of a substrate made of an insulating material such as glass or the like and a casing sealedly mounted on an upper surface of the substrate. The substrate is mounted thereon with a silicon wafer of a rectangular shape acting as a semiconductor chip while being positioned in the envelope. The semiconductor chip has luminous sections arranged in a matrix-like manner thereon. The rectangular silicon wafer is made by slicing a purified or high-purity silicon monocrystal of a circular cylindrical shape into a disc-like shape. The disc-like silicon wafer thus formed is provided thereon with a plurality of rectangular elements each having a required structure incorporated therein. Then, the rectangular elements are cut off.

Such a conventional active matrix drive fluorescent display device will be further described with reference to FIG. 4.

A silicon wafer 100 of a rectangular shape is adhered to a substrate 101 by means of a die bonding paste 102. The silicon wafer 100 is provided on an upper surface thereof with anodes 105 in a matrix-like manner, each of which includes an anode conductor 103 and a phosphor layer 104 deposited on the anode conductor 103. The anodes 105 each are provided thereunder with a transistor acting as a switching element. The silicon wafer 100 is provided on the upper surface thereof with a flat control electrode 106 of a lattice-like shape so as to extend between the anodes 105 adjacent to each other. The active matrix drive fluorescent display device also includes filamentary cathodes 107 stretchedly arranged above the silicon wafer 100 so as to act as an electron source while being positioned in an envelope. The cathodes 107 each include a core wire 107*a* made of a material generating heat due to feeding of a current thereto such as tungsten or the like and an electron emitting substance 107*b* deposited around the core wire 107*a*. The electron emitting substances include oxides of alkaline earth metals including Ba and the like.

The active matrix drive fluorescent display device thus constructed is driven in such a manner that any desired one(s) of the anodes 105 arranged on the silicon wafer 100 is selected by means of the switching element and electrons emitted from the filamentary cathodes 107 are impinged on the phosphor layer 104 of the anode 105 selected. The control electrode 106 has a positive potential constantly applied thereto, so that electrons emitted from the cathodes 107 may be diffused or spread by the control electrode 106, resulting in being uniformly fed to the anodes 105. Such selective driving of the desired anodes 2 in arranged in a matrix-like manner for luminescence leads to any desired graphic display.

During actual driving of the active matrix drive fluorescent display device, the electron emitting substance 107*b* of each of the cathodes 107 is activated to produce free metal, which tends to adhere to the silicon wafer 100. For example, in the conventional fluorescent display device described above, the electron emitting substance 107*b* produces free barium (Ba), which tends to adhere to a cut surface 110 of the silicon wafer 100 which is an outer peripheral end surface of the silicon wafer 100 formed by cutting off it from the disc-like silicon monocrystal, as well as to a periphery thereof.

The outer peripheral end surface of the silicon wafer 100 shown in FIG. 4 constitutes the cut surface 110 of the silicon wafer formed by cutting off it from the disc-like silicon wafer. The cut surface 110 of the silicon wafer 100 is constructed into a laminate structure having the above-described die bonding paste 102, a p-type layer 100*a*, an n-type layer 100*b* and an insulating film 100*c* upwardly laminated on each other in turn. The p-type layer 100*a* is adhered to the substrate 101 through the die bonding paste 102, resulting in providing a portion rendered electrically GND or an electrically GND portion. Such adhesion of free Ba to the cut surface 110 as described above keeps the insulating film 100*c* from carrying out is function, resulting in the electrically GDN portion of the cut surface 110 leading to a failure in insulation between the anodes 105 (phosphor layers 104) and the control electrode 106.

Such a failure in insulation causes the anodes 105 to be actually unintendedly turned on when the control electrode 106 is kept turned on, even when the anodes 105 are kept turned off, resulting in electrons impinging on the phosphor layers 104 of the anodes 105, leading to misluminescence of the phosphor layers. Such misluminescence tends to occur at the phosphor layers 104 positioned in proximity to the cut surface 110 of the silicon wafer 100.

SUMMARY OF THE INVENTION

The present invention has been made in view of the foregoing disadvantage of the prior art.

Accordingly, it is an object of the present invention to provide an active matrix drive fluorescent display device which is capable of preventing misluminescence of phosphor layers due to a failure in insulation between electrodes owing to adhesion of a conductive material to a cut surface of a silicon wafer arranged in an envelope and formed thereon with luminous sections in a matrix-like manner.

It is another object of the present invention to provide a method for manufacturing an active matrix drive fluorescent display device which is capable of providing an active matrix drive fluorescent display device attaining the above-described object.

In accordance with one aspect of the present invention, an active matrix drive fluorescent display device is provided. The active matrix drive fluorescent display device includes an envelope, a semiconductor chip arranged on an inner surface of the envelope, and a plurality of anodes arranged in a matrix-like manner on the semiconductor chip and individually driven. The anodes each have a phosphor layer deposited thereon. Also, the fluorescent display device includes filamentary cathodes arranged in the envelope so as to be positioned above the semiconductor chip. The semiconductor chip is covered on an end surface thereof with an insulating material.

Also, in accordance with this aspect of the present invention an active matrix drive fluorescent display device is provided. The active matrix drive fluorescent display device includes an envelope including a substrate, a semiconductor chip arranged on an inner surface of the substrate of the envelope, switching elements arranged in a matrix-like manner on the semiconductor chip and selectively driven, anodes each arranged on each of the switching elements and having a phosphor layer deposited thereon, a control electrode arranged on the semiconductor element in a manner to extend between the anodes adjacent to each other, and filamentary cathodes each including an electron emitting layer made of a metal oxide and arranged in the envelope so as to be positioned above the semiconductor chip. The semiconductor chip being covered on a cut surface thereof with an insulating material.

In a preferred embodiment of the present invention, the insulating material is a fine powder of a material selected from the group consisting of $Al_2O_3$, $SiO_2$, $ZrO_2$ and frit glass.

In a preferred embodiment of the present invention, the semiconductor chip is formed at a part of a portion thereof in proximity to an outer edge of an upper surface thereof with an electronic element other than the anodes and switching elements. The insulating material is arranged on a cut surface of the semiconductor chip other than a cut surface thereof in proximity to the electronic element.

In accordance with another aspect of the present invention, there is provided a method for manufacturing an active matrix drive fluorescent display device including an envelope including a substrate, a semiconductor chip arranged on an inner surface of the substrate of the envelope, anodes arranged in a matrix-like manner on an upper surface of the semiconductor chip, selectively driven and each having a phosphor layer deposited thereon, and filamentary cathodes arranged in the envelope so as to be positioned above the semiconductor chip. The method includes the step of coating a liquid on a cut surface of the semiconductor chip fixed on the substrate of the envelope. The liquid is prepared by dispersing a fine powder of an insulating material in a solvent. The method also includes the step of calcining the substrate to cover the cut surface of the semiconductor chip with the insulating material.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, the present invention will be described hereinafter with reference to FIGS. 1 to 3.

Figure 1:
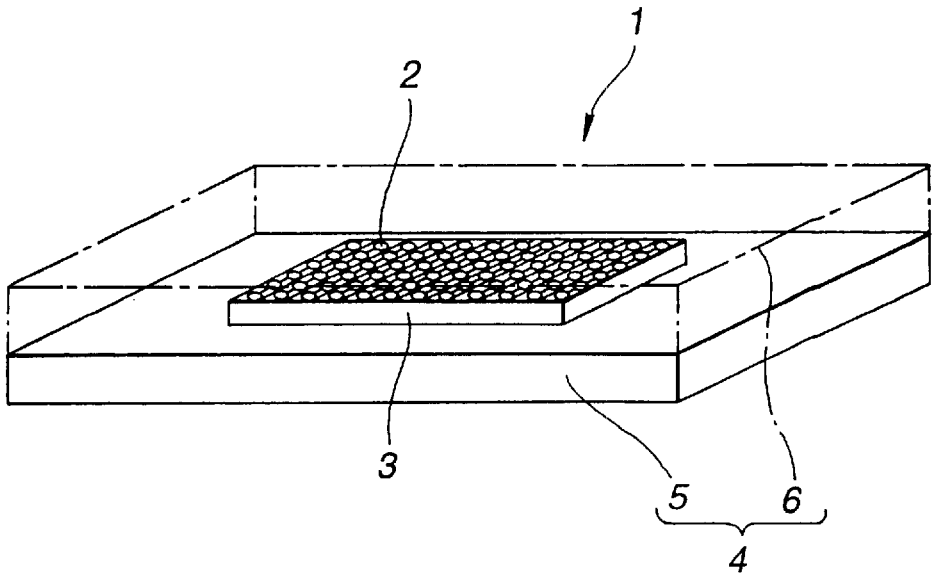
FIG. 1 is a perspective view showing an embodiment of an active matrix drive fluorescent display device according to the present invention.

Referring first to FIG. 1, an embodiment of an active matrix drive fluorescent display device according to the present invention is illustrated. An active matrix drive fluorescent display device of the illustrated embodiment is generally designated at reference numeral 1 in FIG. 1. The active matrix drive fluorescent display device (hereinafter referred to as "fluorescent display device") 1 includes a silicon wafer 3 in the form of a semiconductor chip in which a plurality of anodes 2 individually driven are arranged in a matrix-like manner. The fluorescent display device 1 also includes an envelope 4, which includes a substrate 5 having the above-described silicon wafer 3 mounted on an inner surface thereof. The substrate 5 is made of an insulating material such as glass or the like. The substrate 5 is sealedly mounted thereon with a box-like casing 6, resulting in cooperating with the casing 6 to provide the envelope 4. The envelope 4 is evacuated and kept at a high vacuum.

The substrate 5 is fixedly mounted on an inner surface or upper surface thereof positioned in the envelope 4 with the above-described silicon wafer 3 of a rectangular shape. The silicon wafer 3 has a plurality of dot-like luminous sections arranged in a matrix-like manner on an upper surface thereof. The rectangular silicon wafer 3 is made of a silicon substrate obtained by slicing a purified or high-purity silicon monocrystal of a cylindrical shape into a disc-like shape. More particularly, the silicon wafer 3 is formed in such a manner that a plurality of rectangular elements in each of which luminous dots arranged in a matrix-like manner, transistors each provided for every luminous dot and acting as a switching element, a connection wiring structure for active matrix drive of the luminous dots, drive components such as a driver and a memory, and the like are incorporated are arranged on the disc-like silicon wafer, followed by cutting-off of the rectangular components.

Figure 2:
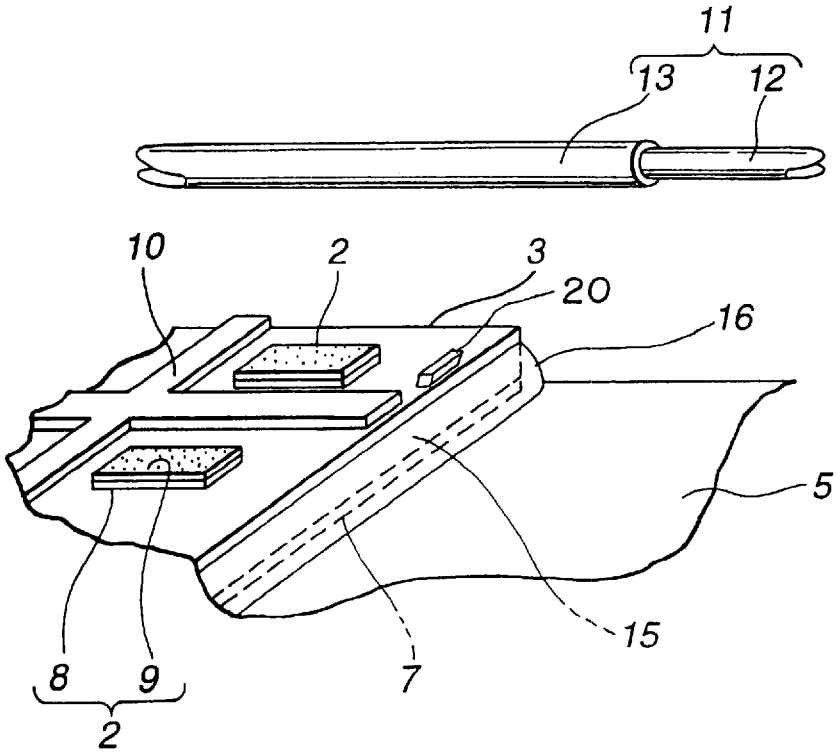
FIG. 2 is an enlarged perspective view showing an end of a silicon wafer arranged in an envelope of the fluorescent display device of FIG. 1.

The thus-formed rectangular silicon wafer 3, as shown in FIG. 2, is adhered to the substrate 5 by means of a die bonding paste 7. The silicon wafer 3 is provided on the upper surface thereof with the anodes 2 in a matrix-like manner, each of which includes an anode conductor 8 and a phosphor layer 9 deposited thereon. The anodes 2 each are provided thereunder with a transistor (not shown) acting as a switching element. The silicon wafer 3 is also provided on the upper surface thereof with a lattice-like flat control electrode 10 in a manner to extend between the anodes 2 adjacent to each other. The envelope 4 is stretchedly provided therein with filamentary cathodes 11 in a manner to be positioned above the silicon wafer 3 and so as to act as an electron source. The cathodes 11 each includes a core wire 12 made of tungsten generating heat due to feeding of a current thereto and an electron emitting substance 13 deposited around the core wire 13. The electron emitting substances may include oxides of alkaline earth metals including Ba and the like.

In the illustrated embodiment, as shown in FIG. 2, the silicon wafer 3 is provided on an outer edge thereof with an electrically GND portion, which is constituted by a cut surface 15 defined by cutting off the silicon wafer 3 from the disc-like silicon substrate. The cut surface 15 is then covered with an insulating material 16, to thereby provide a covered insulating portion. In the illustrated embodiment, an alumina sol is used as the insulating material 16.

The alumina sol is alumina hydrate in the form of a colloid of 5 m$\mu$ to 200 m$\mu$ in size, which is a viscous liquid of a semiopaque color having polymeric particles dispersed therein while permitting an anion in water to act as a stabilizer. The particles are in the form of an aggregate of feather-like or plumose particles. The plumose particles each are formed by polymerization of alumina particles of about sixty-hundred thousands in number. The alumina sol has a surface state wherein the anion contributing to stability of the colloid is present on a surface of each of the particles and in the vicinity thereof, to thereby stabilize the alumina particle. The alumina particles each are positively charged.

The alumina sol is generally classified into three types depending on types (Cl—, $CH_3COO$— and $NO_3$—) of an acid acting as a stabilizer. In the illustrated embodiment, an alumina sol which is free of any halogen and uses $NO_3$— harmless to the filamentary cathodes 11 as a stabilizer is selected. The alumina sol selected has an $Al_2O_3$ content between 20% by weight and 50% by weight, a pH value of 3.0 to 5.0, specific gravity of 1.17 to 1.21, a rod-like or particulate shape, a particle size between 10 nm and 20 nm, a specific surface area of 130 to 270 $cm^2/g$ and viscosity of 1 to 25 (20° C., mPa·s). However, it is a matter of course that any other alumina sol may be used.

Now, manufacturing of the fluorescent display device 1 of the illustrated embodiment will be described with reference to FIG. 3. Steps indicated by bracketed numerals described below indicate steps correspond to those shown in FIG. 3.

(1) First, rectangular components or elements for the fluorescent display device 1 are incorporated into a sliced circular silicon wafer (5 inches in diameter and 0.6 mm in thickness). By way of example, seventeen such rectangular elements (silicon wafers 3) are formed on a single circular silicon wafer.

(2) Then, the circular silicon wafer is uniformly coated on an upper surface thereof with a phosphor slurry containing ultraviolet sensitive resin.

(3) Ultraviolet rays emitted from a UV lamp are irradiated onto the upper surface of the circular silicon wafer through a mask formed with apertures in a manner to correspond to arrangement of the luminous dots.

(4) Then, development is carried out using water and then unhardened phosphor slurry is removed by washing, resulting in a phosphor pattern being formed on the upper surface of the circular silicon wafer.

(5) Subsequently, acrylic resin dispersed in acetone is coated on the upper surface of the circular silicon wafer on which the phosphor pattern is thus formed and then dried, so that an acrylic protective layer may be formed on the upper surface of the silicon wafer.

(6) Then, a dicing step is carried out. More particularly, the rectangular elements (silicon wafers 3) are cut off from the circular silicon wafer by dicing using a diamond cutter or the like. During the cutting-off, water is dashed over the circular silicon wafer for the purpose of removal of shavings and the like. The acrylic protective layer formed in the above-described step (5) functions to prevent the phosphor from being removed or peeled by the water. The acrylic resin is decomposed at a low temperature, resulting in being removed by the subsequent step.

(7) A die bonding step is executed. The rectangular elements thus cut off are adhesively bonded to an upper surface of the substrate 5 of the fluorescent display device 1 by means of the die bonding paste 7 made of a mixture of Ag and organic Ti. The die bonding paste made of Ag and organic Ti is readily decomposed, to thereby be kept from remaining in the envelope 4 after completion of the fluorescent display device.

(8) The rectangular elements are small-sized, to thereby be hard to hold by hands. Also, it is not desirable to directly hold the elements by hands in order to prevent pollution thereof. Mounting of the rectangular elements on the substrate 5 in the die bonding step (7) described above permits the elements to be handled through the substrate 5. The above-described alumina sol (insulating material 16) is coated on the cut surface 15 of each of the rectangular elements mounted on the substrate 5 by means of a small knife or spatula made of stainless steel.

(9) A calcination step is carried out. This permits resin contained in the phosphor layers 9, the acrylic resin used to cover the phosphor layers and the die bonding paste 7 to be thermally decomposed. The alumina sol is calcined, to thereby be set or solidified, resulting in forming the covered insulating film.

(10) Thereafter, a wire bonding step takes place. This permits the rectangular elements to be connected to the electrodes on the substrate 5 by means of wires.

(11) A surface mounting step is carried out. More particularly, a finished lead frame is positioned on a predetermined position of the substrate 5 and then the finished casing 6 is put on the lead frame, followed by temporary fixing of these members using any suitable fixing means such as a clip or the like.

(12) Then, calcination is executed at a temperature of about 450° C. for sealing. More particularly, the calcination permits seal glass between the casing 6 and the substrate 5 to be melted, resulting in the casing 6, lead frame and substrate 5 being fixed together.

(13) The envelope 4 is evacuated, so that a high vacuum atmosphere may be formed in the envelope 4. Then, an evacuation tube is sealed. A getter is then scattered to form a getter film on the inner surface of the envelope 4.

(14) Calcination is carried out at a temperature of about 160° C. to 300° C., gas remaining in the envelope may be absorbed on the getter film.

(15) A lead terminal of the lead frame projected from the envelope 4 is polished and then solder is adhered to the polished lead terminal.

(16) Then, the fluorescent display device 1 thus provided is subject to aging.

(17) Thereafter, the fluorescent display device 1 is subject to display inspection.

The fluorescent display device 1 of the illustrated embodiment, as described above, is so constructed that the cut surface 15 of the silicon wafer 3 which is rendered electrically GND due to adhesion of free Ba thereto is covered with the insulating material 16. Such construction of the illustrated embodiment ensures insulation between the electrically GND portion and the control electrode 10 and anodes 2, to thereby prevent short-circuiting, even when any free metal such as Ba or the like emitted from the filamentary cathodes 11 adheres to the cut surface 15 of the silicon wafer 3. This effectively prevents misluminescence of the anodes 2. The upper surface of the silicon wafer 3 includes an area on which the matrix-like dots of the anodes 2 are arranged and an area on which the drive elements such as the driver 20, memories and the like are arranged. The phosphors positioned in proximity to the cut surface 15 of the silicon wafer 3 tends to cause misluminescence. The fluorescent display device of the illustrated embodiment effectively eliminates such a disadvantage.

Figure 3:
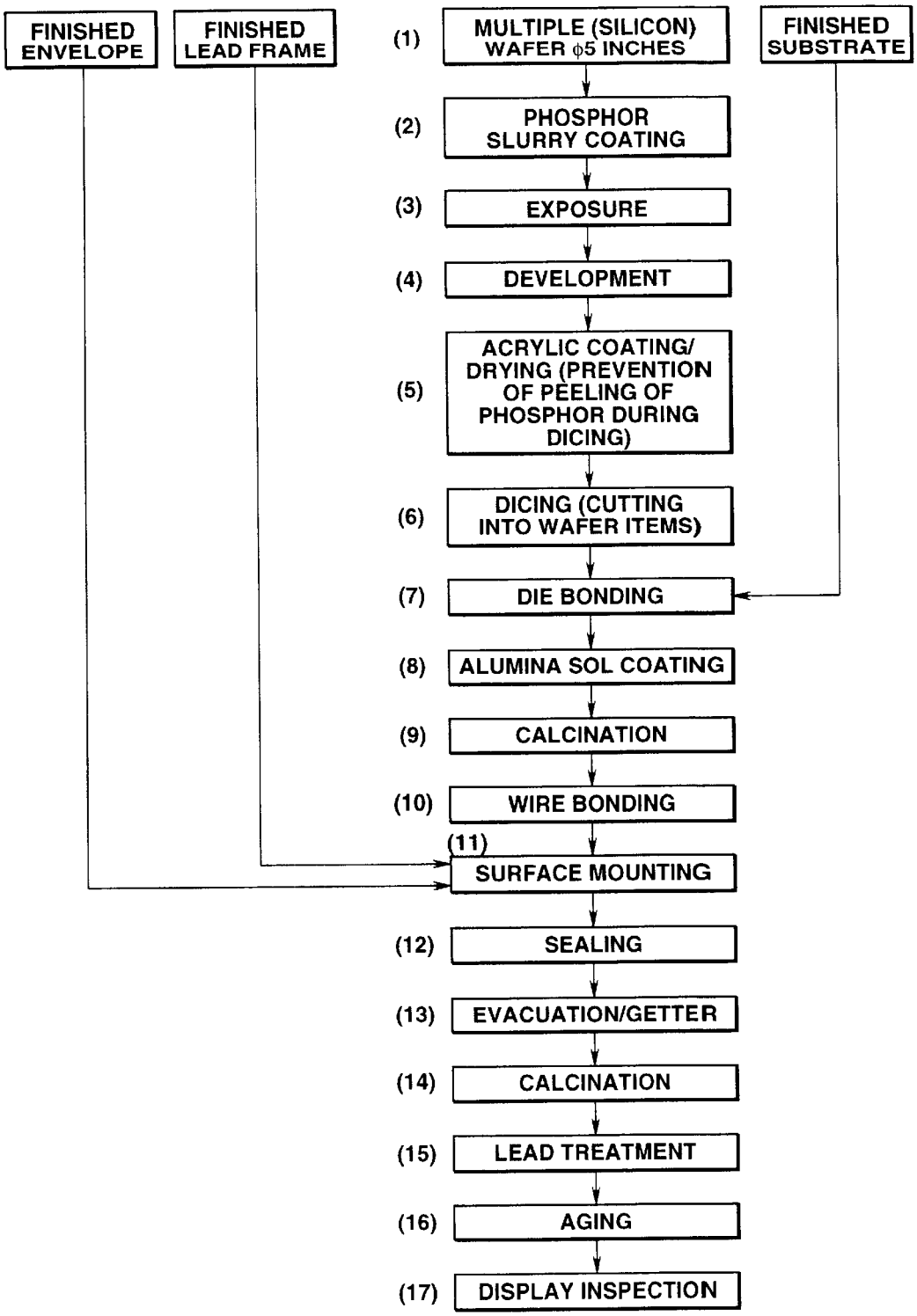
FIG. 3 is a flow chart showing manufacturing of the fluorescent display device of FIG. 1.
Figure 4:
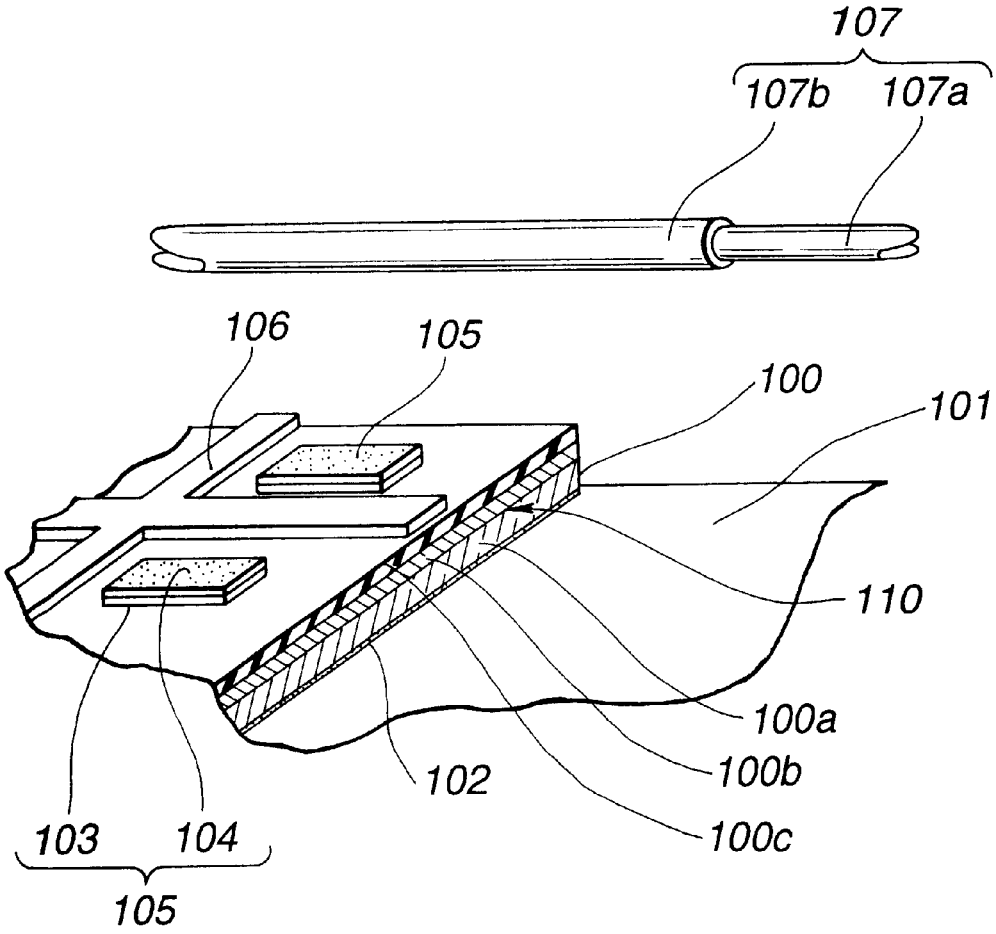
FIG.4 (PRIOR ART)
FIG. 4 is an enlarged perspective view showing an end of a silicon wafer arranged in an envelope of a conventional active matrix drive fluorescent display device.

In the dicing step (6) in the manufacturing shown in FIG. 3, cooling water tends to cause the phosphor to flow out, leading to adhesion of the flowing-out phosphor to the cut surface 15 of the silicon wafer 3, although the outflow is slight. Retention of the phosphor on the cut surface 15 causes the fluorescent display device 1 to generate leakage luminescence when it is driven, as semen in the prior art.

In the illustrated embodiment, the silicon wafer diced is fixed on the substrate 5 and then the cut surface 15 of the silicon wafer 3 is covered with the insulating material 16. Therefore, even when the phosphor adheres to the cut surface 15 of the silicon wafer 3, the phosphor is covered with the insulating material, resulting in effectively preventing such leakage luminescence and misluminescence as described above.

In the illustrated embodiment, the protective layer or insulating cover layer for covering the cut surface 15 of the silicon wafer 3 while insulating it is made of alumina sol. Alternatively, the insulating cover layer may be made of any other insulating material such as $SiO_2$, $ZrO_2$, organic metal (organic Ti or the like), frit glass or the like. Such an insulating material is coated in the form of sol of a fine powder thereof.

Also, in the illustrated embodiment, the semiconductor chip fixed on the substrate 5 in the envelope 4 of the active matrix drive fluorescent display device 1 is constituted by the silicon wafer 3. However, a semiconductor chip of any other suitable form may be effectively used in the illustrated embodiment so long as it is provided with an electrically GND portion such as an end surface which is rendered electrically GND and causes an electrical disadvantage due to adhesion of a conductive material discharged from the cathodes thereto.

As can be seen form the foregoing, the fluorescent display device of the present invention is so constructed that the semiconductor chip which includes the plural luminous dots arranged in a matrix-like manner and is arranged in the envelope is covered on the cut surface thereof rendered electrically GND with the insulating cover layer. Such construction eliminates a failure in insulation between the electrodes arranged on the chip, to thereby prevent misluminescence of the luminous dots, leading to an increase in display quality.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An active matrix drive fluorescent display device comprising:

an envelope;

a semiconductor chip arranged on an inner surface of said envelope;

a plurality of anodes arranged in a matrix on said semiconductor chip and individually driven;

said anodes each having a phosphor layer deposited thereon; and filamentary cathodes arranged in said envelope so as to be positioned above said semiconductor chip, wherein said semiconductor chip is covered on an end surface thereof with an insulating material, and said insulating material comprises a fine powder of a material selected from a group consisting of $Al_2O_3$, $SiO_2$, $ZrO_2$ and frit glass.

2. An active matrix drive fluorescent display device comprising:

an envelope including a substrate;

a semiconductor chip arranged on an inner surface of said substrate of said envelope;

switching elements arranged in a matrix on said semiconductor chip and selectively driven;

anodes arranged on respective of said switching elements and having a phosphor layer deposited thereon;

a control electrode arranged on said semiconductor chip in a manner to extend between said anodes adjacent to each other; and filamentary cathodes each including an electron emitting layer made of a metal oxide and arranged in said envelope so as to be positioned above said semiconductor chip, wherein said semiconductor chip is covered on a first cut surface thereof with an insulating material, and said semiconductor chip includes an electronic element other than said anodes and switching elements formed at a portion of the semiconductor chip in proximity to an outer edge of an upper surface of said semiconductor chip, and said insulating material covers a second cut surface of said semiconductor chip not in proximity to said electronic element.

3. A method for manufacturing an active matrix drive fluorescent display device including an envelope including a substrate, a semiconductor chip arranged on an inner surface of said substrate of said envelope, anodes arranged in a matrix-like manner on an upper surface of said semiconductor chip and selectively driven, said anodes each having a phosphor layer deposited thereon, and filamentary cathodes arranged in said envelope so as to be positioned above said semiconductor chip, comprising the steps of:

coating a liquid on a cut surface of said semiconductor chip fixed on said substrate of said envelope, said liquid being prepared by dispersing a fine powder of an insulating material in a solvent; and calcining said substrate to cover said cut surface of said semiconductor chip with said insulating material.

* * * * *